US010374306B2

(12) United States Patent
Zhang et al.

(10) Patent No.: US 10,374,306 B2
(45) Date of Patent: Aug. 6, 2019

(54) MIMO ANTENNA HAVING ADJUSTABLE DECOUPLING STRUCTURE

(71) Applicant: Huawei Technologies Co., Ltd., Shenzhen, Guangdong (CN)

(72) Inventors: Ming Zhang, Hangzhou (CN); Bin Wang, Hangzhou (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/706,373

(22) Filed: Sep. 15, 2017

(65) Prior Publication Data

US 2018/0019515 A1 Jan. 18, 2018

Related U.S. Application Data

(63) Continuation of application No. PCT/CN2015/074304, filed on Mar. 16, 2015.

(51) Int. Cl.

| | |
|---|---|
| ***H01Q 21/00*** | (2006.01) |
| ***H01Q 1/52*** | (2006.01) |
| ***H01Q 1/24*** | (2006.01) |
| ***H01Q 1/38*** | (2006.01) |
| ***H01Q 9/42*** | (2006.01) |
| ***H01Q 21/28*** | (2006.01) |

(52) U.S. Cl.

CPC ..... *H01Q 1/521* (2013.01); *H01Q 1/243* (2013.01); *H01Q 1/38* (2013.01); *H01Q 1/52* (2013.01); *H01Q 9/42* (2013.01); *H01Q 21/28* (2013.01)

(58) Field of Classification Search

CPC ..... H01Q 21/061; H01Q 1/246; H01Q 9/16; H01Q 1/52; H01Q 1/125

USPC ..... 343/893, 841, 852, 853

See application file for complete search history.

(56) References Cited

U.S. PATENT DOCUMENTS

| | | | |
|---|---|---|---|
| 2011/0228713 | A1 | 9/2011 | Alexopoulos et al. |
| 2013/0300629 | A1 | 11/2013 | Jiang et al. |
| 2014/0118214 | A1 | 5/2014 | Tanaka |
| 2014/0152523 | A1 | 6/2014 | Wu et al. |

(Continued)

FOREIGN PATENT DOCUMENTS

| | | | |
|---|---|---|---|
| CN | 102110900 | A | 6/2011 |
| CN | 102394348 | A | 3/2012 |

(Continued)

OTHER PUBLICATIONS

Kasra Payandehjoo et al.,"Compact Multi-Band PIFAs on a Semi-Populated Mobile Handset With Tunable Isolation", IEEE Transactions on Antennas and Propagation, vol. 61, No. 9, Sep. 2013, 6 pages.

(Continued)

*Primary Examiner* — Dameon E Levi
*Assistant Examiner* — Collin Dawkins

(57) ABSTRACT

A MIMO antenna is disclosed, including: a first antenna, a second antenna, and an adjustable decoupling structure. The adjustable decoupling structure is disposed between the first antenna and the second antenna, and is configured to reduce coupling between the first antenna and the second antenna. The adjustable decoupling structure includes a first adjustable capacitor and a second adjustable capacitor that are connected in series and a first adjustable inductor and a second adjustable inductor that are connected in parallel.

5 Claims, 5 Drawing Sheets

(56) References Cited

U.S. PATENT DOCUMENTS

| | | | | |
|---|---|---|---|---|
| 2014/0159986 | A1* | 6/2014 | De Luis | H01Q 1/521<br>343/852 |
| 2016/0006119 | A1* | 1/2016 | Wu | H01Q 1/523<br>343/853 |

FOREIGN PATENT DOCUMENTS

| | | | |
|---|---|---|---|
| CN | 202839957 | U | 3/2013 |
| CN | 203103510 | U | 7/2013 |
| CN | 103855469 | A | 6/2014 |
| EP | 2571101 | A1 | 3/2013 |

OTHER PUBLICATIONS

Ping Tyng Chua et al., "Microstrip decoupling networks for low—order multiport arrays with reduced element spacing", Microwave and Optical Technology Letters, vol. 46, No. 6, Jan. 1, 2005, XP055159013, 16 pages.

* cited by examiner

MIMO ANTENNA HAVING ADJUSTABLE DECOUPLING STRUCTURE

CROSS-REFERENCE TO RELATED APPLICATIONS

This application is a continuation of International Application No. PCT/CN2015/074304, filed on Mar. 16, 2015, the disclosure of which is hereby incorporated by reference in its entirety.

TECHNICAL FIELD

The present application relates to the field of communications technologies, and in particular, to a MIMO antenna having an adjustable decoupling structure.

BACKGROUND

A MIMO (Multi-input Multi-output) antenna technology is a core technology in MIMO wireless communications technologies. A conventional SISO (Single-input Single-output) antenna system has an unbreakable bottleneck in a channel capacity-limitation of a Shannon capacity. When no size is limited, a throughput rate of a system is multiplied with an increasing quantity of antennas.

However, a size of a terminal device is strictly limited. When multiple antennas are concentrated in small space, great mutual coupling may be caused, and performance of the antennas deteriorates accordingly. How to implement high isolation between multiple antenna units on a terminal side in a case of a limited size is a difficulty in antenna design.

In an existing method for implementing high MIMO antenna isolation, two antenna units are connected by using a neutralization line, and a coupling current between the antennas is neutralized by using the neutralization line, and therefore antenna isolation is improved. However, in this manner in which the neutralization line is used, only an antenna that operates in a specific frequency band can be isolated. If an operating frequency of the antenna changes, neutralization lines of different lengths are required.

SUMMARY

The present disclosure provides a MIMO antenna having an adjustable decoupling structure, so as to isolate multiple antenna units that operate in different frequency bands.

A MIMO antenna is provided, including:

a first antenna;

a second antenna; and an adjustable decoupling structure, disposed between the first antenna and the second antenna, and configured to reduce coupling between the first antenna and the second antenna, where the adjustable decoupling structure includes a first adjustable capacitor and a second adjustable capacitor that are connected in series and a first adjustable inductor and a second adjustable inductor that are connected in parallel.

Specifically, an equivalent circuit of the adjustable decoupling structure includes a first decoupling circuit and a second decoupling circuit, and circuit structures of the first decoupling circuit and the second decoupling circuit are the same and symmetrically disposed.

Specifically, the first decoupling circuit includes the first adjustable capacitor and the second adjustable capacitor that are connected in series and the first adjustable inductor and the second adjustable inductor that are connected in parallel; one end of the first adjustable capacitor is connected to a first port, and the other end of the first adjustable capacitor is connected to a first node; one end of the second adjustable capacitor is connected to the first node, and the other end of the second adjustable capacitor is connected to the second adjustable inductor; two ends of the first adjustable inductor are separately connected to the first node and a second node; and one end of the second adjustable inductor is connected to the second adjustable capacitor, and the other end of the second adjustable capacitor is connected to the second node.

Specifically, each antenna is connected to an adjustable matching network, and the adjustable matching network is used to adjust frequency bands of the first antenna and the second antenna.

Specifically, the MIMO antenna includes a controller, configured to control the adjustable matching network to adjust the frequency bands of the first antenna and the second antenna; where the controller is further configured to control an induction value of an adjustable inductor or a capacitance value of an adjustable capacitor in the adjustable decoupling structure.

Specifically, the first adjustable inductor and the second adjustable inductor are electronic devices or microstrip inductors, and the first adjustable capacitor and the second adjustable capacitor are electronic devices or microstrip capacitors.

The MIMO antenna having an adjustable decoupling structure implements decoupling between a first antenna and a second antenna by using the adjustable decoupling structure, and the adjustable decoupling structure includes adjustable series capacitors and adjustable parallel inductors, so that decoupling can be performed between antennas that operate in different frequency bands.

BRIEF DESCRIPTION OF THE DRAWINGS

To describe the technical solutions in the embodiments of the present disclosure more clearly, the following briefly describes the accompanying drawings required for describing the embodiments. Apparently, the accompanying drawings in the following description show merely some embodiments of the present disclosure, and persons of ordinary skill in the art may still derive other drawings from these accompanying drawings without creative efforts.

DETAILED DESCRIPTION

The following clearly describes the technical solutions in the embodiments of the present disclosure with reference to the accompanying drawings in the embodiments of the present disclosure. Apparently, the described embodiments are a part rather than all of the embodiments of the present disclosure. All other embodiments obtained by persons of ordinary skill in the art based on the embodiments of the present disclosure without creative efforts shall fall within the protection scope of the present disclosure.

Figure 1:
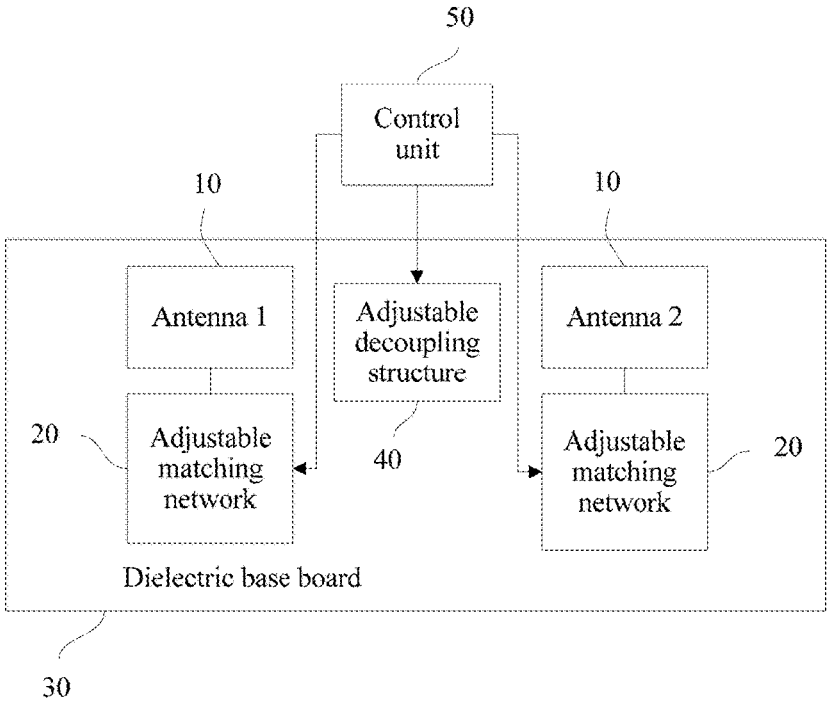
FIG. 1 is a composition diagram of Embodiment 1 of a MIMO antenna according to the present disclosure.

Referring to FIG. 1, in an embodiment of the present disclosure, a MIMO antenna system includes at least two antennas 10 and an adjustable decoupling structure 40 disposed between the two antennas 10. Each antenna 10 is connected to an adjustable matching network 20, and the adjustable matching network 20 is used to adjust a frequency band of an antenna connected to the adjustable matching network 20. The MIMO antenna system further includes a control unit 50. The control unit 50 is connected to the adjustable matching network 20, and is configured to control the adjustable matching network 20 to adjust the frequency band of the antenna. The control unit 50 is also connected to the adjustable decoupling structure 40, so as to adjust the adjustable matching network 20 to decouple antennas that operate at different operating frequencies. The at least two antennas 10 are disposed on a dielectric base board 30. The back of the dielectric base board 30 is covered with metal film and is used as a ground plate. The two antennas 10 may be disposed at the front of the dielectric base board 30. The adjustable decoupling structure 40 may also be printed at the front of the dielectric base board 30.

Figure 2:
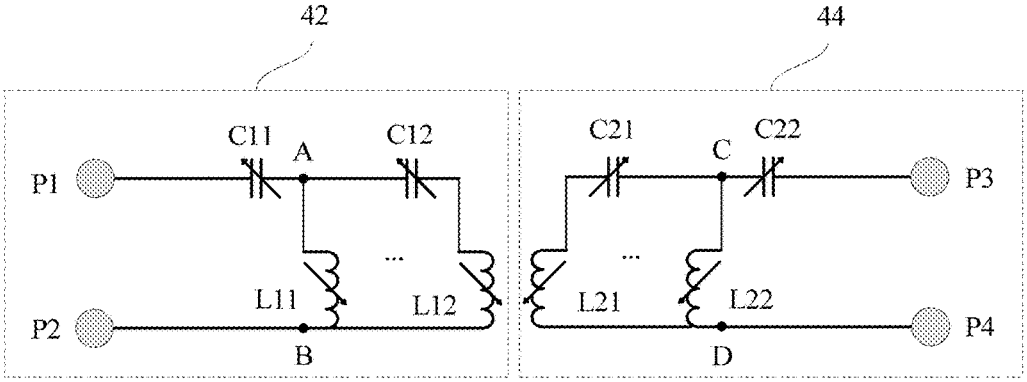
FIG. 2 is a diagram of a circuit or an equivalent circuit of an adjustable decoupling structure in FIG. 1.

The adjustable decoupling structure 40 may be implemented in a form of a circuit that includes an electronic device, or in a form of a microstrip structure. In an embodiment, a structure of a circuit or an equivalent circuit of the adjustable decoupling structure 40 is shown in FIG. 2, and specifically includes:

a first decoupling circuit 42, where the first decoupling circuit 42 includes capacitors C11 and C12 and inductors L11 and L12; one end of the capacitor C11 is connected to a first port P1, and the other end of the capacitor C11 is connected to a node A; one end of the capacitor C12 is connected to the node A, and the other end of the capacitor C12 is connected to the inductor L12; two ends of the inductor L11 are separately connected to the node A and a node B, and the node B is connected to a second port P2; and one end of the inductor L12 is connected to the capacitor C12, and the other end of the inductor L12 is connected to the node B; and a second decoupling circuit 44, where the second decoupling circuit 44 includes capacitors C21 and C22 and inductors L21 and L22; one end of the capacitor C22 is connected to a third port P3, and the other end of the capacitor C22 is connected to a node C; one end of the capacitor C21 is connected to the node C, and the other end of the capacitor C21 is connected to the inductor L21; two ends of the inductor L22 are separately connected to the node C and a node D, and the node D is connected to a fourth port P4; and one end of the inductor L21 is connected to the capacitor C21, and the other end of the inductor L21 is connected to the node D.

Circuit structures of the first decoupling circuit 42 and the second decoupling circuit 44 are the same and symmetrically disposed. Both the first decoupling circuit 42 and the second decoupling circuit 44 include series capacitors and parallel inductors. The capacitors C11, C12, C21, and C22 are all adjustable capacitors. The inductors L11, L12, L21, and L22 are all adjustable inductors.

In this embodiment of the present disclosure, the capacitors C11, C12, C21, and C22 may be digital capacitors, and the control unit 50 may output a digital signal to control a capacitance value of the digital capacitor. The inductors L11, L12, L21, and L22 may be digital inductors, and the control unit 50 may output a digital signal to control an inductance value of the digital inductor. A capacitance value and/or an inductance value of the adjustable decoupling structure 40 is adjusted, so that the adjustable decoupling structure 40 has different resonance frequencies. A higher operating frequency of the antenna 10 requires a higher resonance frequency of the adjustable decoupling structure 40, so that a requirement for decoupling a MIMO antenna can be met. When two antennas in the MIMO antenna system are operating, interference energy generated between the two antennas may be absorbed by the adjustable decoupling structure, and a capacitor in the adjustable decoupling structure can generate an effect of an open circuit, so that decoupling and isolation effects can be achieved, and isolation of the MIMO antenna meets a design requirement.

In actual application, the adjustable decoupling structure 40 may achieve decoupling by including one of the first decoupling circuit 42 or the second decoupling circuit 44.

Figure 3:
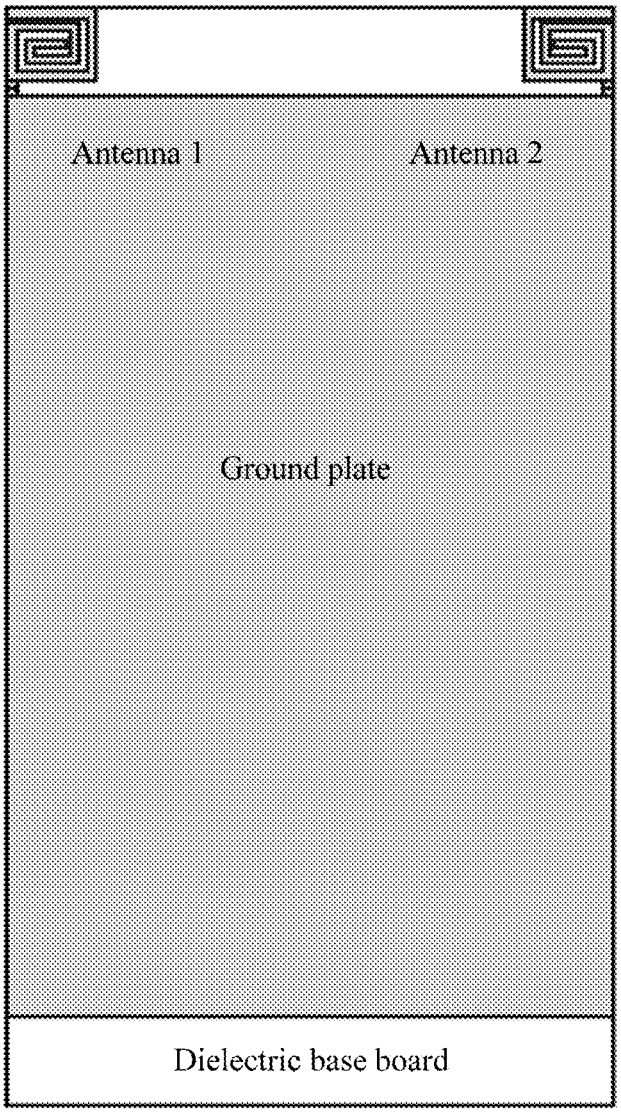
FIG. 3 is a schematic structural diagram of a MIMO antenna for which no decoupling structure is disposed.
Figure 4:
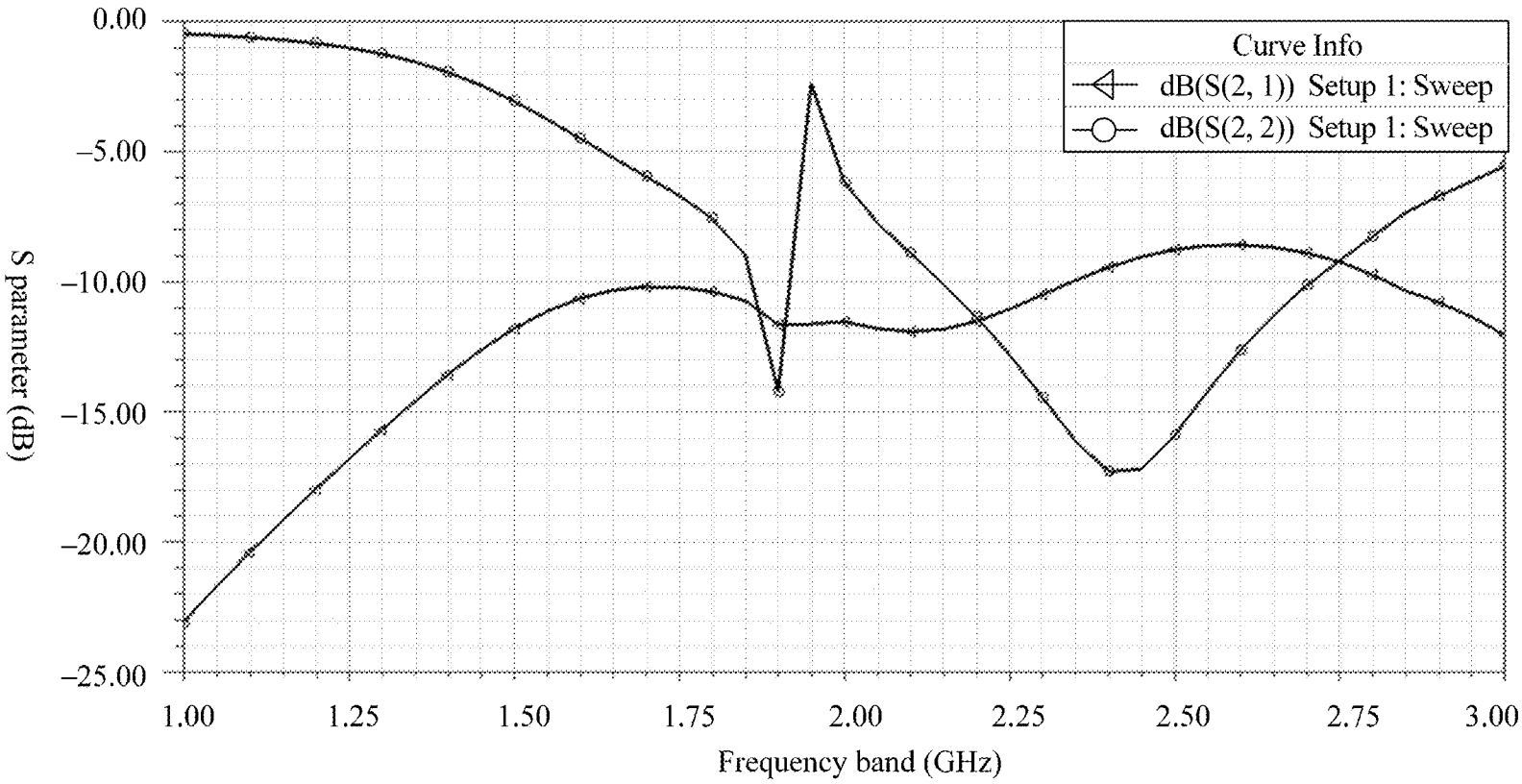
FIG. 4 is a diagram of simulating isolation of the MIMO antenna for which no decoupling structure is disposed in FIG. 3.

Referring to FIG. 3, no decoupling structure is disposed between an antenna 1 and an antenna 2. In FIG. 4, two curves S (2, 1) and S (2, 2) respectively represent a return loss curve and an isolation curve of a MIMO antenna in FIG. 3. It may be learned from a simulation diagram in FIG. 4 that, when 2 GHz is used as an example of an operating frequency of an antenna, isolation between the antenna 1 and the antenna 2 in a MIMO antenna system is about −6 dB that is greater than −10 dB, maximum isolation specified during antenna design, and this means that decoupling between the antenna 1 and the antenna 2 is relatively large.

Figure 5:
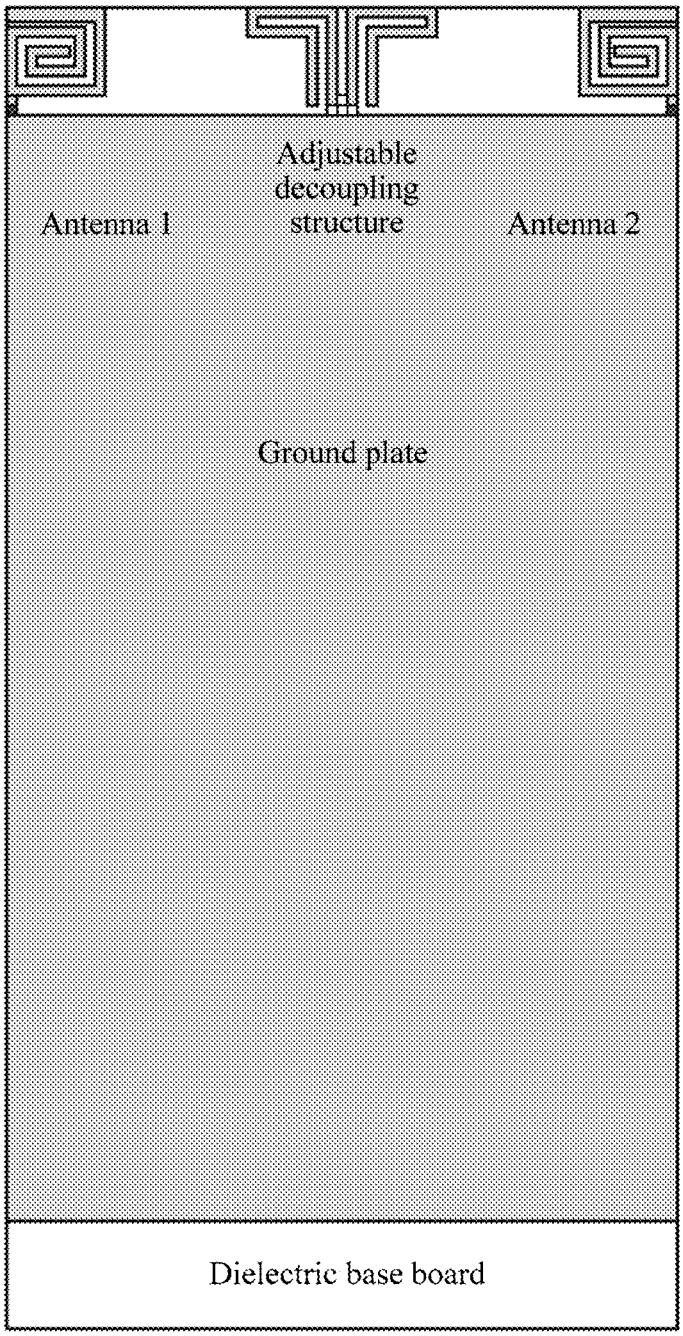
FIG. 5 is a schematic structural diagram of a MIMO antenna for which an adjustable decoupling structure is disposed.
Figure 6:
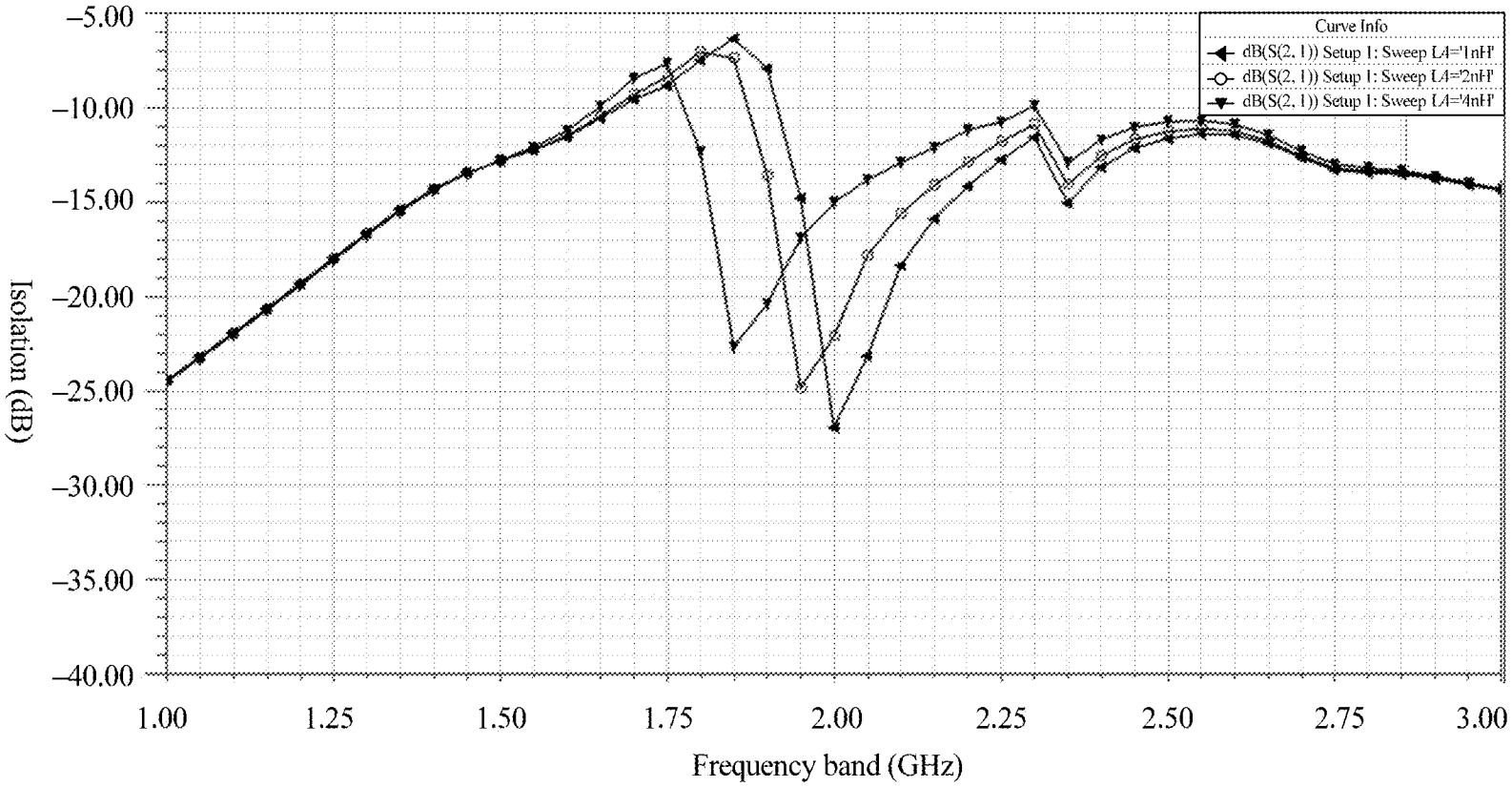
FIG. 6 is a curve graph of simulating different isolation that is of the MIMO antenna for which an adjustable decoupling structure is disposed in FIG. 5 and that is corresponding to different inductance values.

Referring to FIG. 5, an adjustable decoupling structure may be disposed between the antenna 1 and the antenna 2. As shown in FIG. 6, three curves are isolation curves of a MIMO antenna in FIG. 5 when inductance values are separately 1 nH, 2 nH, and 3 nH. When 2 GHz is still used as an example of an operating frequency of an antenna, isolation values corresponding to the three isolation curves are separately −27 dB, −22 dB, and −15 dB that are all less than −10 dB, maximum isolation specified during antenna design. In addition, when the operating frequency of the antenna is 2 GHz, an inductance value is smaller and isolation is higher.

The present disclosure discloses a MIMO antenna having an adjustable decoupling structure, and the adjustable decoupling structure may implement decoupling between an antenna 1 and an antenna 2 in any frequency band, thereby providing a MIMO antenna having a simple decoupling structure and an adjustable decoupling frequency band.

The foregoing descriptions are merely specific implementation manners of the present disclosure, but are not intended to limit the protection scope of the present disclosure. Any variation or replacement readily figured out by persons skilled in the art within the technical scope disclosed in the present disclosure shall fall within the protection scope of the present disclosure. Therefore, the protection scope of the present disclosure shall be subject to the protection scope of the claims.

What is claimed is:

1. A MIMO antenna, comprising:

a first antenna;

a second antenna; and an adjustable decoupling structure disposed between the first antenna and the second antenna and configured to reduce coupling between the first antenna and the second antenna, wherein the adjustable decoupling structure comprises, a first adjustable capacitor and a second adjustable capacitor connected in series, a first adjustable inductor and a second adjustable inductor that are connected in parallel, and a first decoupling circuit comprising the first and second adjustable capacitors and the first and second adjustable inductors, wherein one end of the first adjustable capacitor is connected to a first port and another end of the first adjustable capacitor is connected to a first node, one end of the second adjustable capacitor is connected to the first node, and the other end of the second adjustable capacitor is connected to the second adjustable inductor, two ends of the first adjustable inductor are separately connected to the first node and a second node, and one end of the second adjustable inductor is connected to the second adjustable capacitor, and the other end of the second adjustable capacitor is connected to the second node, and a second decoupling circuit having a same circuit structure as the first decoupling circuit, and wherein the second decoupling circuit and first decoupling circuit are symmetrically disposed.

2. The MIMO antenna according to claim 1, further comprising:

a first adjustable matching network coupled to the first antenna and configured to adjust a frequency band of the first antenna; and a second adjustable matching network coupled to the second antenna and configured to adjust a frequency band of the second antenna.

3. The MIMO antenna according to claim 2, further comprising:

a controller configured to control the first and second adjustable matching networks to adjust the frequency bands of the first antenna and the second antenna, and control an induction value of at least one of the first and second adjustable inductors or a capacitance value of at least one of the first and second adjustable capacitors.

4. The MIMO antenna according to claim 1, wherein the first adjustable inductor and the second adjustable inductor each comprise one of an electronic device or a microstrip inductor.

5. The MIMO antenna according to claim 1, wherein the first adjustable capacitor and the second adjustable capacitor each comprise one of an electronic device or a microstrip capacitor.

* * * * *